US011686115B2

(12) United States Patent
Gantt

(10) Patent No.: US 11,686,115 B2
(45) **Date of Patent: *Jun. 27, 2023**

(54) WALL BRACE SYSTEM AND METHOD

(71) Applicant: Independence Materials Group, LLC, Virginia Beach, VA (US)

(72) Inventor: William A. Gantt, Blair, SC (US)

(73) Assignee: Independence Materials Group, LLC, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/467,780

(22) Filed: Sep. 7, 2021

(65) Prior Publication Data

US 2021/0404199 A1 Dec. 30, 2021

Related U.S. Application Data

(63) Continuation of application No. 16/420,035, filed on May 22, 2019, now Pat. No. 11,142,920.
(Continued)

(51) Int. Cl.
*E04G 23/02* (2006.01)
*E02D 31/10* (2006.01)
(Continued)

(52) U.S. Cl.
CPC ..... *E04G 23/0229* (2013.01); *E02D 31/10* (2013.01); *E04G 21/26* (2013.01); *E04G 23/04* (2013.01)

(58) Field of Classification Search
CPC ..... E02D 31/10; E04G 21/26; E04G 23/0229; E04G 23/04
See application file for complete search history.

(56) References Cited

U.S. PATENT DOCUMENTS 587,274 A 7/1897 Rue
2,850,254 A 9/1958 Houseworth
(Continued)

FOREIGN PATENT DOCUMENTS

CN 2749989 U 1/2006
CN 103291117 A 9/2013
GB 543741 A 3/1942

OTHER PUBLICATIONS

Deep Excavation LLC, Support Systems for Deep Excavations: Cross-lot/Internal Bracing—Braced Excavations, http://www.deepexcavation.com/en/braced-excavations-struts-crosslot, accessed Aug. 9, 2017, 6 pages.

*Primary Examiner* — James M Ference
(74) *Attorney, Agent, or Firm* — Moore & Van Allen PLLC; Jeffrey R. Gray

(57) ABSTRACT

A wall brace system for providing an apparatus for supporting a wall in a building structure, which has been moved inward by pressure from the earth outside in order to return the wall to a desired position. The wall brace system has a structural member, a retainer, a mounting assembly, a load member, a jack, and/or a locking member. A jack and/or locking member are operatively coupled between the structural member and the mounting assembly. The jack functions to exert a force against the structural member, directly or through the load member, in order to force the structural member toward the wall for shifting the wall (e.g., outwardly). The locking member functions to lock the structural member in place with respect to the mounting assembly after the jack positions the structural member. Thereafter, the jack is removed from the mounting assembly.

15 Claims, 20 Drawing Sheets

Related U.S. Application Data

(60) Provisional application No. 62/674,962, filed on May 22, 2018.

(51) Int. Cl.
*E04G 21/26* (2006.01)
*E04G 23/04* (2006.01)

(56) References Cited

U.S. PATENT DOCUMENTS

| | | | | |
|---|---|---|---|---|
| 3,030,061 | A | 4/1962 | Jennings | |
| 3,796,055 | A | 3/1974 | Mahony | |
| 3,817,006 | A | 6/1974 | Williams | |
| 3,971,179 | A | 7/1976 | Bodocsi et al. | |
| 4,068,427 | A | 1/1978 | Camardo | |
| 4,189,891 | A | 2/1980 | Johnson et al. | |
| 4,353,194 | A | 10/1982 | Norton | |
| 4,452,028 | A | 6/1984 | Norton et al. | |
| 4,453,863 | A | 6/1984 | Sutton et al. | |
| 4,757,651 | A | 7/1988 | Crites | |
| 4,763,878 | A | 8/1988 | Abraham et al. | |
| 4,893,784 | A | 1/1990 | Abraham et al. | |
| 5,011,336 | A | 4/1991 | Hamilton et al. | |
| 5,013,190 | A | 5/1991 | Green | |
| 5,575,591 | A | 11/1996 | Vanderklaauw | |
| 5,800,094 | A | 9/1998 | Jones | |
| 5,829,220 | A | 11/1998 | Zumeta | |
| 5,845,450 | A | 12/1998 | Larsen | |
| 6,142,710 | A | 11/2000 | Holland, Jr. et al. | |
| 6,352,390 | B1 | 3/2002 | Jones | |
| 6,357,190 | B1 | 3/2002 | Florentine | |
| 6,659,692 | B1 | 12/2003 | May | |
| 6,662,505 | B2 | 12/2003 | Heady et al. | |
| 6,769,222 | B2 | 8/2004 | Billante | |
| 7,419,335 | B1 | 9/2008 | Cohen | |
| 7,681,361 | B1 | 3/2010 | Jendusa et al. | |
| 7,681,367 | B2 | 3/2010 | Morton et al. | |
| 7,735,268 | B1 | 6/2010 | Zidar et al. | |
| 7,774,995 | B1 | 8/2010 | Zidar, Jr. | |
| 7,788,859 | B2 | 9/2010 | Trotter | |
| 7,861,469 | B2 | 1/2011 | Heady et al. | |
| 7,913,463 | B2 * | 3/2011 | Russell | E04G 17/14 52/651.1 |
| 8,136,317 | B1 | 3/2012 | Mccown | |
| 8,590,259 | B2 | 11/2013 | Trinko et al. | |
| 8,925,267 | B1 | 1/2015 | Kirby | |
| 9,028,176 | B1 | 5/2015 | Malloy | |
| 9,422,734 | B1 | 8/2016 | Heady et al. | |
| 10,669,730 | B1 | 6/2020 | Taylor | |
| 2002/0062612 | A1 | 5/2002 | Heady et al. | |
| 2002/0121066 | A1 * | 9/2002 | Callahan | E04B 5/12 52/715 |
| 2002/0176749 | A1 | 11/2002 | Provost | |
| 2003/0126820 | A1 * | 7/2003 | Callahan | E04C 3/02 52/220.8 |
| 2004/0071511 | A1 | 4/2004 | May | |
| 2004/0091322 | A1 | 5/2004 | May | |
| 2005/0144885 | A1 | 7/2005 | Nau | |
| 2005/0172427 | A1 | 8/2005 | Sykes | |
| 2005/0204673 | A1 | 9/2005 | Reed | |
| 2005/0238442 | A1 | 10/2005 | Queen | |
| 2006/0080926 | A1 | 4/2006 | Resch et al. | |
| 2006/0260220 | A1 | 11/2006 | Ennis et al. | |
| 2007/0227082 | A1 | 10/2007 | Morton et al. | |
| 2009/0078843 | A1 | 3/2009 | Trotter | |
| 2009/0245942 | A1 | 10/2009 | Hawkins et al. | |
| 2012/0204512 | A1 | 8/2012 | Trinko et al. | |
| 2019/0360221 | A1 | 11/2019 | Gantt | |
| 2021/0404199 | A1 * | 12/2021 | Gantt | E04G 23/04 |

* cited by examiner

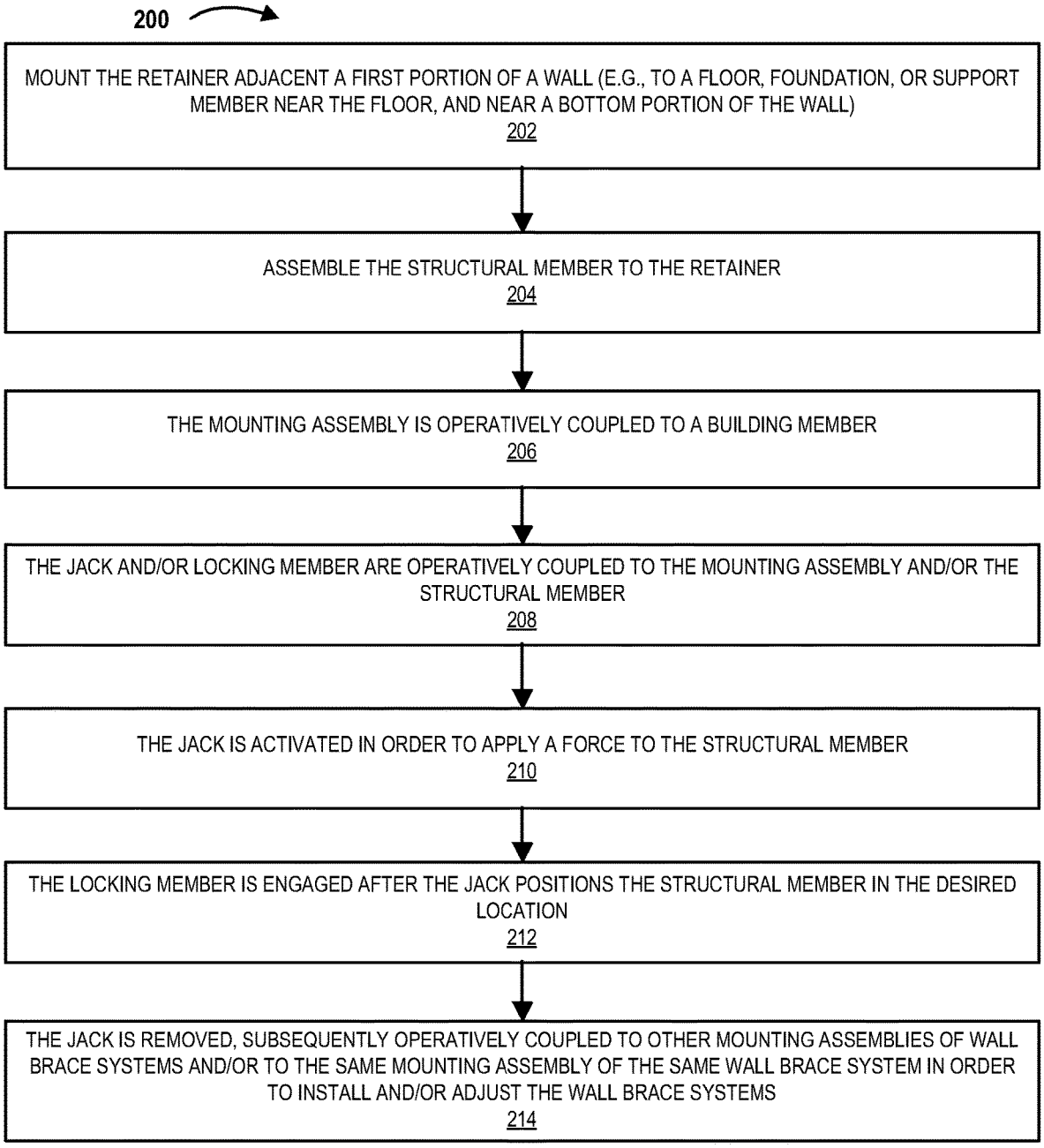
*FIG.* 33

WALL BRACE SYSTEM AND METHOD

CROSS REFERENCE AND PRIORITY CLAIM UNDER 35 U.S.C. § 119

The present application is a continuation of, and claims priority to U.S. patent application Ser. No. 16/420,035 entitled "Wall Brace System and Method" filed on May 22, 2019, which claims priority to U.S. Provisional Patent Application Ser. No. 62/674,962 entitled "Wall Brace System and Method" filed on May 22, 2018, both of which are assigned to the assignee hereof and hereby expressly incorporated by reference herein.

FIELD

The present disclosure relates to a wall brace system and method for use in straightening and supporting a leaning or bowed wall and, in particular, a wall brace system and method using a hydraulic jack to move a foundation wall.

BACKGROUND

A foundation wall, such as a basement wall, is typically constructed of concrete. The concrete can be poured as a solid wall, or individual concrete blocks can be stacked with mortar placed between the blocks to form the wall. Since a basement wall is at least partially underground, lateral pressure associated with the surrounding soil and hydrostatic pressure from water in the soil results in horizontally-directed inward force which may cause the wall to deflect inwardly. Sufficient inward deflection will cause a solid concrete wall to fracture or cause cracks to appear along mortar joints on the inner surface of a block wall forced inwardly. Additionally, such inwardly directed forces can move rows of blocks or the entire wall. If such deflection continues unabated, the entire wall may buckle and collapse with likely damage to the supported structure.

A number of methods are available for straightening and reinforcing a foundation wall experiencing deflection. Conventionally, a structural member, such as a steel I-beam, is placed vertically against an interior surface of the leaning or bowed foundation wall. The structural member is braced against other structural members of the building, such as the concrete floor at the base of the wall and a floor joist at the top of the wall. A threaded rod extends horizontally from a secure mounting position for engaging the structural member. The threaded rod is manually turned such that the end of the rod engaging the structural member pushes the structural member and the wall back toward a vertical position. The structural member is then typically left in place to resist the lateral forces.

For the forgoing reasons, there is a need for a new wall brace system and method that applies a force to a foundational wall and retains a structural member against inwardly-directed force against the wall. Ideally, the wall system and method may be used for forcing a foundation wall back out to its original position after pressure from the outside of the wall has moved the wall inwardly.

BRIEF SUMMARY

Embodiments of the invention relate to wall brace systems. The wall brace system provides an apparatus for supporting a wall in a building structure, which has been moved inward by pressure from the earth outside in order to return the wall to a desired position. The wall brace system comprises a structural member, a retainer, a mounting assembly, a load member, a jack, and/or a locking member. The structural member can be any type of beam of any shape. The structural member is configured to be seated vertically against the inner surface of the wall where pressure can be directed through the structural member toward the wall. The retainer may be operatively coupled adjacent the wall, and a portion of the structural member may be operatively coupled to the retainer. The mounting assembly is configured to be operatively coupled to a building member. A jack and/or locking member are operatively coupled between the structural member (e.g., directly or through the use of a load member) and the mounting assembly. The jack functions to exert a force against the structural member, directly or through the load member, in order to force the structural member toward the wall for shifting the wall (e.g., outwardly). The locking member, which may be a fastener, functions to lock the structural member in place with respect to the mounting assembly after the jack positions the structural member. Thereafter, the jack is removed from the mounting assembly and may be used on other wall brace systems.

Embodiments of the invention comprise a wall bracing system. The system comprises a structural member having a first end and a second end, and the first end of the structural member is operatively coupled adjacent a first portion of a wall. The system further comprises a mounting assembly that is operatively coupled to a building member. The system also comprises a jack and/or locking member operatively coupled to the mounting assembly, and the jack is configured to adjust the structural member and the locking member is configured to resist movement of the structural member.

In further accord with embodiments of the invention, at least a portion of the jack is removable while the locking member remains operatively coupled to the mounting assembly and the structural member.

In other embodiments, the system further comprises a retainer, and the retainer is operatively coupled to the structural member adjacent the first end of the structural member.

In yet other embodiments, the system further comprises a load member operatively coupled between the structural member and the jack and the locking member.

In still other embodiments, the load member comprises a jack interface that is configured to support a jack end of the jack. In some embodiments the jack interface is a jack socket.

In other embodiments, the load member comprises a locking interface that is configured to support a locking member. In some embodiments the locking interface comprises a locking socket.

In further accord with embodiments of the invention, the mounting assembly comprises a base plate that is operatively coupled to the building member, and one or more support brackets operatively coupled to the base plate. The one or more support brackets are configured for operative coupling with the jack or the locking member.

In some embodiments, the jack is a hydraulic jack, pneumatic jack, or electric jack. In some embodiments, the locking member comprises a rod, a bolt and nut, or a pin.

In some embodiments, the first end of structural member is operatively coupled adjacent the first portion of the wall at a basement floor, a foundation, or basement floor member. In some embodiments, the mounting assembly is operatively coupled to a building floor, a floor member, or a vertical support member.

In further accord with some embodiments, the structural member comprises an I-beam, a round beam, a square beam, or a beam with channels.

In other embodiments, the jack is operatively coupled to the mounting assembly separate from the locking member that is operatively coupled to the mounting assembly, wherein the jack and the locking member engage the structural member at separate locations.

In yet other embodiments, the jack is operatively coupled to the locking member, and the jack adjusts the structural member through the locking member, and wherein the jack may be removed from the locking member.

In still other embodiments, the system further comprises a second structural member having a first end and a second end, and the first end of the second structural member is operatively coupled adjacent the first portion of a wall. The system also comprises a second mounting assembly that is operatively coupled to the building member or a second building member. The system further comprises a second jack and a second locking member operatively coupled to the second mounting assembly. The second jack is configured to adjust the second structural member and the second locking member is configured to resist movement of the second structural member. In this way, the jack and the second jack may be operatively coupled and are configured to apply loads to the structural member and the second structural member at the same time when activated.

Embodiments of the invention comprise a method for bracing a wall. The method comprises installing a structural member adjacent a wall and installing a mounting assembly to a building member. The method further comprises activating a jack operatively coupled to the mounting assembly to adjust a position of the structural member. The method also comprises engaging a locking member operatively coupled to the mounting assembly to resist movement of the structural member, and removing the jack from the mounting assembly.

In further accord with embodiments of the present disclosure, the method further comprises installing a retainer adjacent a lower portion of the wall, and installing the structural member comprises installing the structural member to the retainer.

In some embodiments of the invention, the method further comprises installing a load member to the structural member. The load member comprises one or more interfaces for receiving an end of the jack or an end of the locking member, and the load member engages with the end of the jack or the end of the locking member during installation.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE DRAWINGS

For a more complete understanding of the present invention, reference should now be had to the embodiments shown in the accompanying drawings and described below. In the drawings:

FIG. 33 is a process for installing one or more wall brace systems, in accordance with embodiments of the present disclosure.

DESCRIPTION

Embodiments of the present disclosure now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

Figure 3:
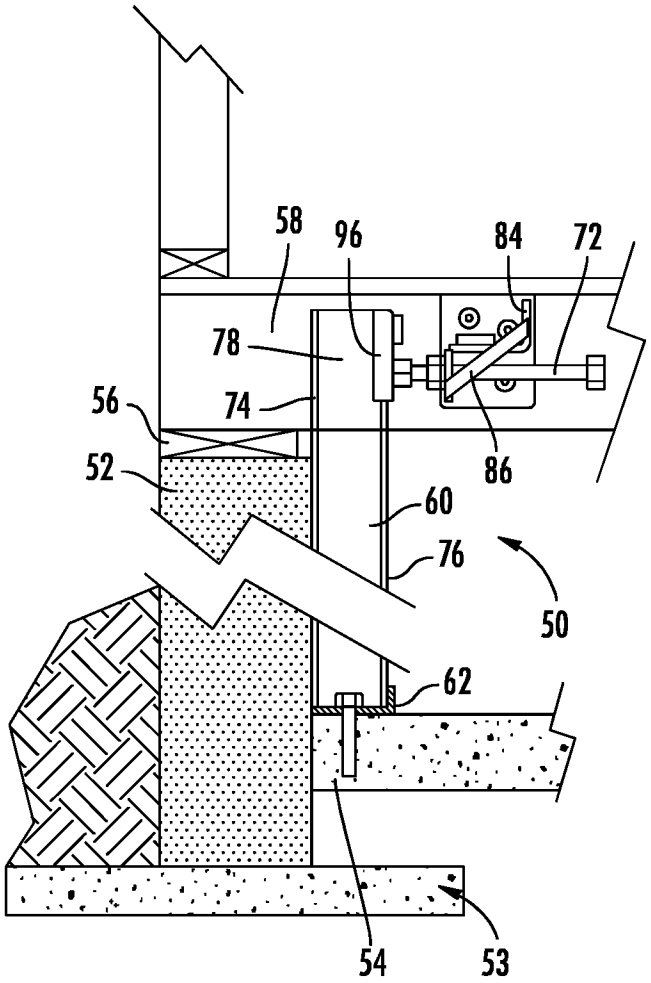
FIG. 3 is a side elevation cut-away view of the wall brace system in position against a wall as shown in FIG. 1 with a hydraulic ram removed and further illustrating a washer plate in phantom.
Figure 2:
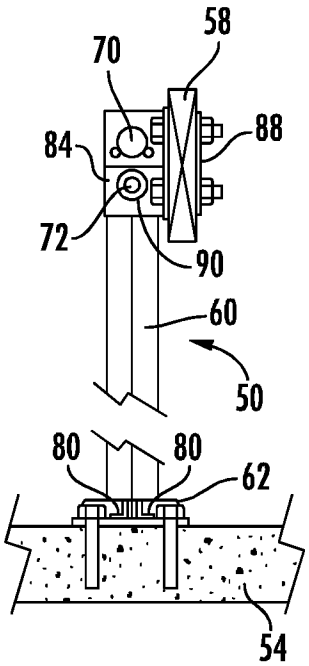
FIG. 2 is a front elevation cut-away view of the wall brace system in position against a wall as shown in FIG. 1.
Figure 1:
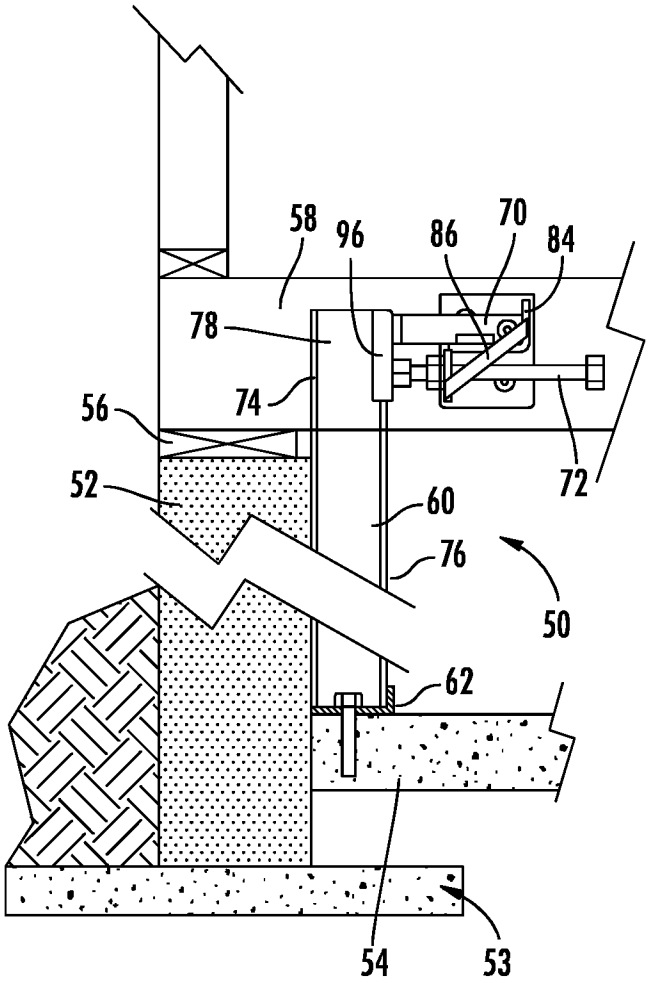
FIG. 1 is a side elevation cut-away view of a wall brace system in position against a wall between a floor and a joist, in accordance with some embodiments of the present disclosure.

Referring now to the drawings, a wall brace system is shown in FIGS. 1-3 and generally designated at 50 in accordance with some embodiments of the present disclosure. A solid concrete wall 52 is also shown, but the particular material of the wall 52 is irrelevant and could include concrete blocks, wood, composites, any other suitable material, and/or combinations thereof. A floor 54, such as a basement floor, may be operatively coupled to (e.g., intersects, or the like) the wall 52 or other surface (e.g., a foundation 53, or the like) on which the wall 52 rests. The floor 54 and/or other surface (e.g., a foundation 53) may also be constructed of poured concrete, but again the material is irrelevant and could made of any suitable material or combinations of materials. Atop the wall 52 is a sill plate 56 on which rests a plurality of floor joists 58, one of which is shown in FIGS. 1-3. Although not shown, it is understood that the wall 52 has sustained some form of lateral damage, such as inward bowing, tilting or horizontal shear, or it is anticipated that the wall 52 will sustain such damage in the future.

Figure 4:
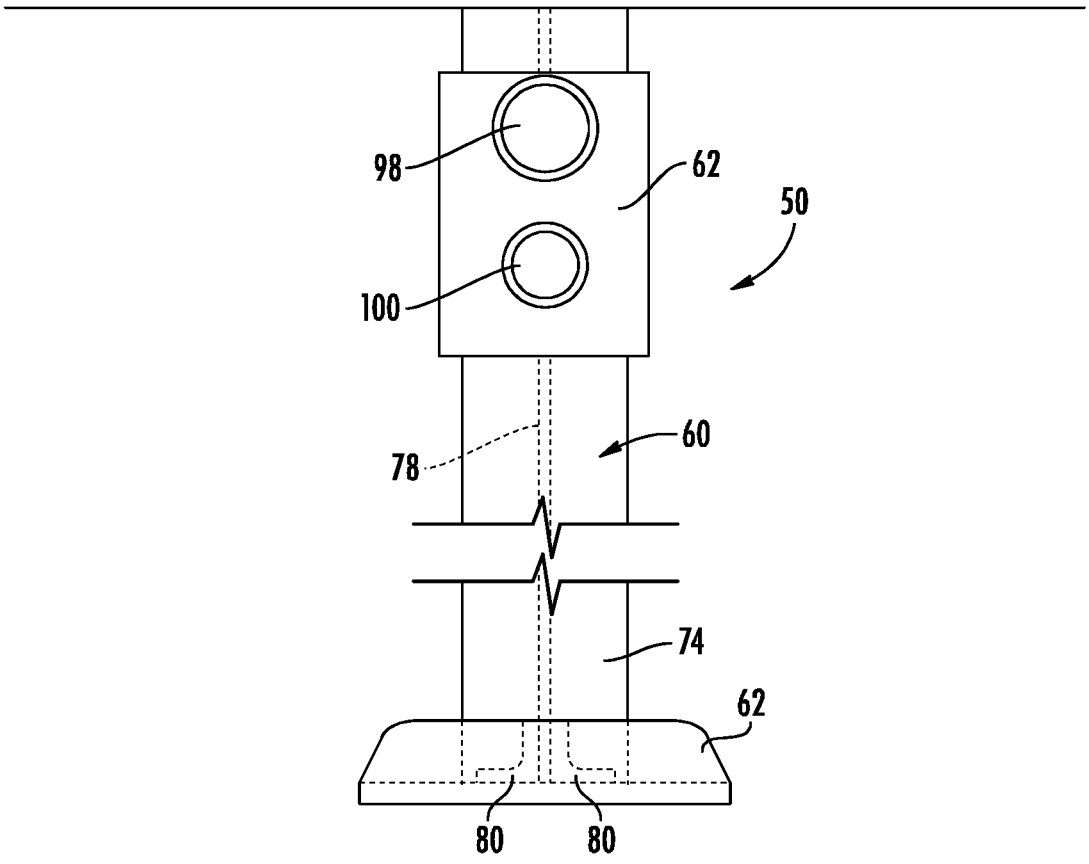
FIG. 4 is a schematic front elevation cut-away view of a portion of a wall brace system as shown in FIG. 1 including a beam, a bottom retainer, beam clips, and a load member.
Figure 5:
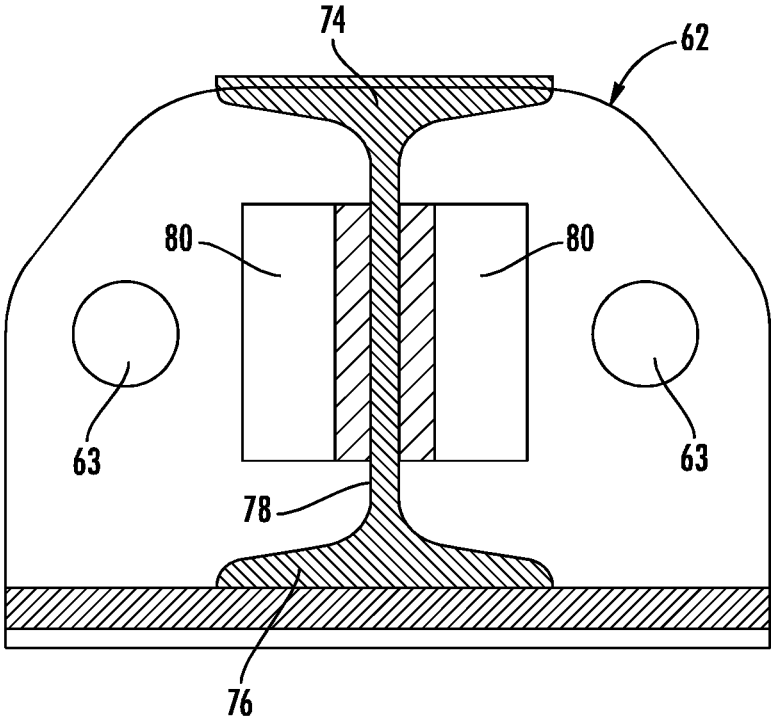
FIG. 5 is a transverse cross-section view of the beam, bottom retainer, and beam clips as shown in FIG. 4.
Figure 6A:
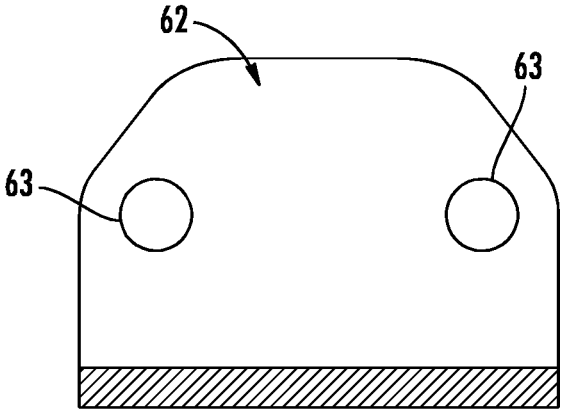
FIG. 6A is a transverse cross-section view of the bottom retainer as shown in FIG. 4.
Figure 6B:
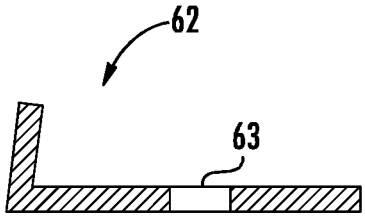
FIG. 6B is a longitudinal cross-section view of the bottom retainer as shown in FIG. 4.
Figure 6C:
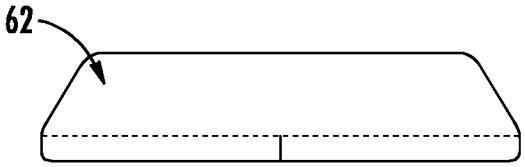
FIG. 6C is a longitudinal cross-section view of the bottom retainer as shown in FIG. 4.
Figure 6D:
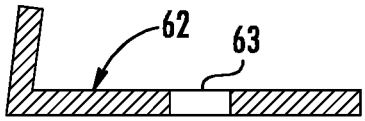
FIG. 6D is a front elevation view of the bottom retainer as shown in FIG. 4.
Figure 7A:
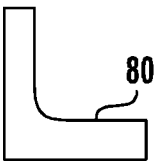
FIG. 7A is a transverse cross-section view of a beam clip as shown in FIG. 4.
Figure 7B:
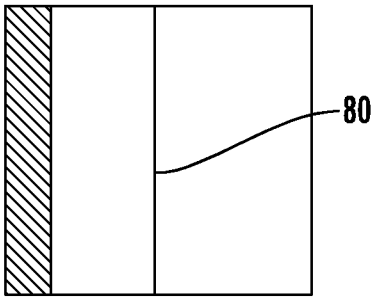
FIG. 7B is a side elevation view of a beam clip as shown in FIG. 4.
Figure 8:
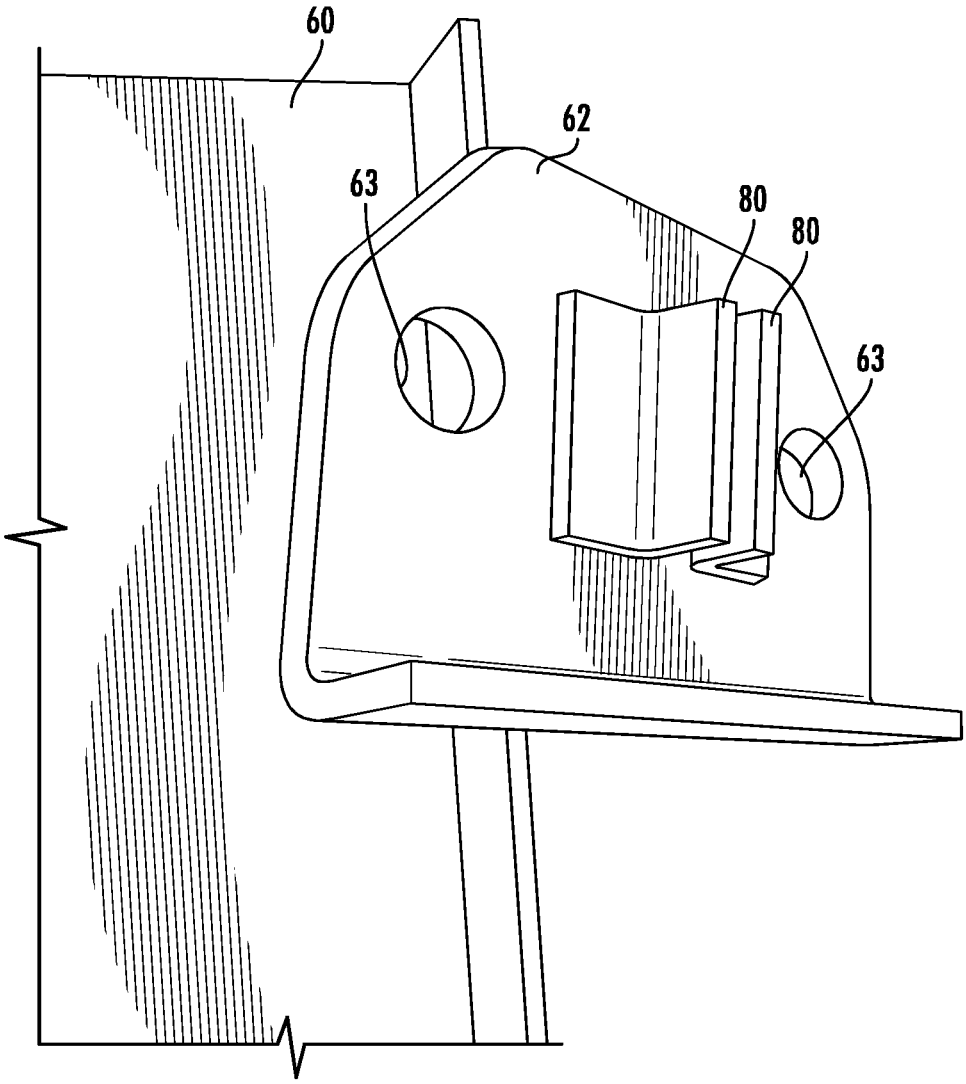
FIG. 8 is a perspective view of the bottom retainer and beam clips, in accordance with some embodiments of the present disclosure.
Figure 9:
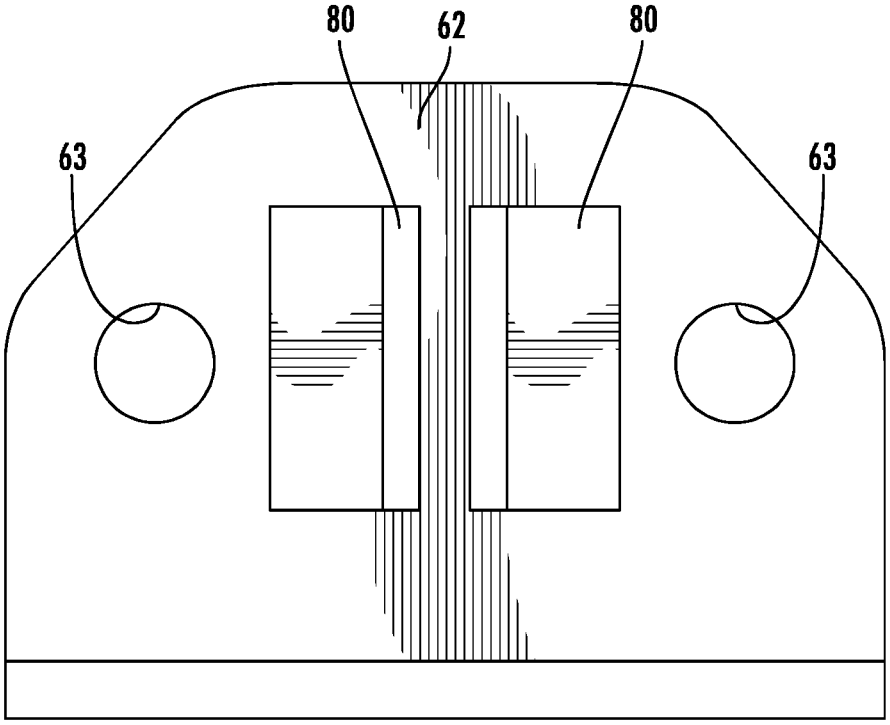
FIG. 9 is a top plan view of the bottom retainer and beam clips as shown in FIG. 8.

In some embodiments, the wall brace system 50 provides an apparatus for supporting a wall 52 in a building, which has been moved inward by pressure from the earth outside in order to return the wall 52 to a desired position (e.g., its original position, or another position). The wall brace system 50 comprises a structural member 60, a retainer 62 (e.g., a bottom retainer, such as a bottom retainer plate, or the like), a mounting assembly 64 (e.g., mounting plate assembly, such as a joist mounting plate assembly, or the like), and/or a load member 66 (e.g., load plate, or the like). The structural member 60 can be any type of beam, such as an I-beam as shown in the figures, an H-beam, a C-channel beam, a beam of any shape (e.g., circular, oval, rectangular, square, triangular, or the like) that is solid or hollow, a flat rigid plate or any other such member. The structural member 60 may be made out of any type of material, such as steel, a composite, or another material. The beam 60 is configured to be seated vertically against the inner surface of the wall 52 where pressure can be directed through the beam 60 toward the wall 52, as illustrated in FIGS. 1 and 3. The beam may have a first end (e.g., lower end) that is configured for installation (e.g., mounting, or the like) adjacent a first portion of the wall (e.g., near the bottom of the wall, or other portion of the wall that requires support), and a second end (e.g., upper end) that is configured for installing (e.g., mounting, or the like) adjacent a second portion of the wall (e.g., near the top of the wall, or other portion of the wall that requires support). The bottom retainer 62 may be operatively coupled to (e.g., mounted to, or the like) the floor 54, foundation 53, or another basement floor member (not illustrated). A portion of the lower end of beam 60 may be operatively coupled (e.g., secured, or the like) to the bottom retainer 62 and placed against the wall 52, as illustrated in FIG. 4. The beam 60 extends upwardly away from the floor 54, foundation 53, or another basement floor member.

As shown in FIGS. 1-3, the mounting assembly 64 is configured to operatively couple (e.g., rigidly secure, or the like) the upper end of the beam 60 to a building member, such as a joist 58, building floor (e.g., above the basement floor 54), and/or vertical support member (e.g., between the basement floor 54 or member thereof and the building floor or member thereof) in order to resist (e.g., prevent, reduce, or the like) movement of the upper end of the beam. The upper end of the beam 60 and the mounting plate assembly 64 may be spaced apart from each other. In some embodiments, a load member 66 is operatively coupled to the beam 60, such as interfaces with a surface of the beam 60, fits over the beam 60, wraps around a portion of the beam 60 (e.g., around a flange and/or web of an I-beam, or the like), fits within a channel of the beam 60 (e.g., within a c-shaped channel, or the like), or the like. A jack 70 and/or locking member 72 operatively couple (e.g., are interposed between, or the like) the mounting assembly 64 and the beam 60, as illustrated in FIG. 1. As will described below, the jack 70, which may be a hydraulic jack, pneumatic jack, electric jack, and/or other type of powered or manual jack, functions to exert a force (e.g., a horizontally-directed force, or the like) against the beam 60, directly or through a load member 66, in order to force the beam 60 toward the wall 52 for shifting the wall (e.g., outwardly). As will be further described below the locking member 72, which may be a fastener (e.g., bolt, screw, rod, pin, and/or nut, or the like), functions to lock the beam 60 in place with respect to the mounting assembly 64 after the jack 70 positions the beam 60 (e.g., biases the beam towards the wall, or the like).

As shown in the drawings, in some embodiments of the present disclosure, the beam 60 is formed in an "I"-shape (I-beam) having an outer flange 74 and an inner flange 76 connected by a web 78 (e.g., at the midsections of the flanges). It is understood, as discussed herein, that the beam 60 could be another structural member of suitably sturdy construction, which is defined herein as a structural member 60 that can resist a bending force applied to it. Suitable substitutes may include, but are not limited to, structural members 60 that include channels, round or square tubes, or other shapes of any material, dimensional lumber (4×4, 4×6, etc.), composite beams, or any other structural member 60.

Referring to FIGS. 5-9, in some embodiments of the present disclosure, the retainer 62 has one or more holes 63 (e.g., a pair of holes, or the like) formed for receiving fasteners. It should be understood that the holes 63 may be enclosed (e.g., circular) or open (e.g., slotted and open on one end). The retainer 62 is configured for operative coupling (e.g., attachment, or the like) to the floor 54, foundation 53, or the like adjacent the base of the wall 52 by inserting a pair of fasteners (e.g., bolts, or the like) through the holes 63 in the bottom retainer 62 and into the floor 54, foundation 53, or the like. In one arrangement, holes 63 are predrilled into the floor 54 and cement poured therein. When fasteners (e.g., threaded, ribbed, or the like) are inserted, the cement dries around the fasteners (e.g., around the threads, ribs, or the like), resulting in long-lasting holding power.

Figure 10:
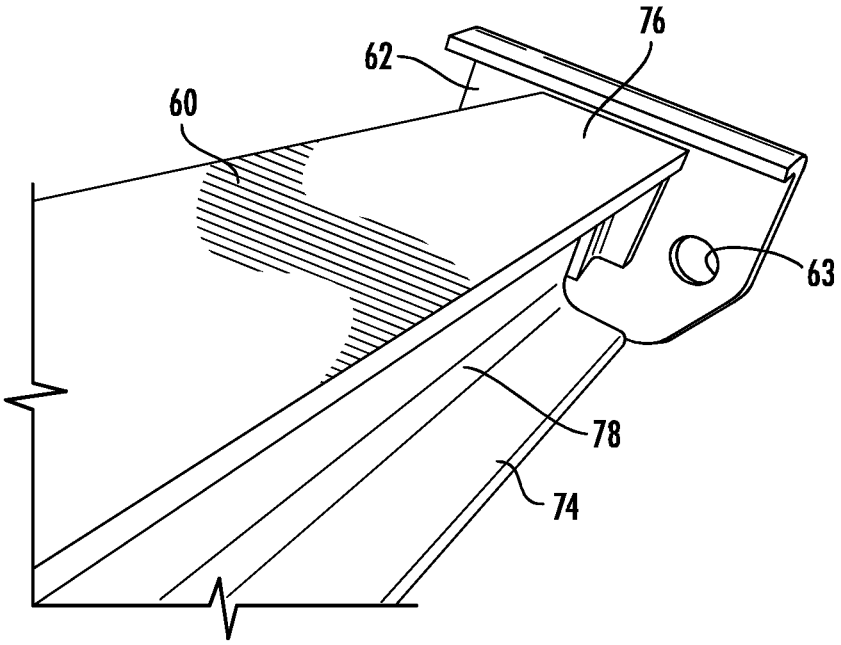
FIG. 10 is a perspective view of the bottom retainer, beam clips, and installed I-beam, in accordance with some embodiments of the present disclosure.
Figure 11:
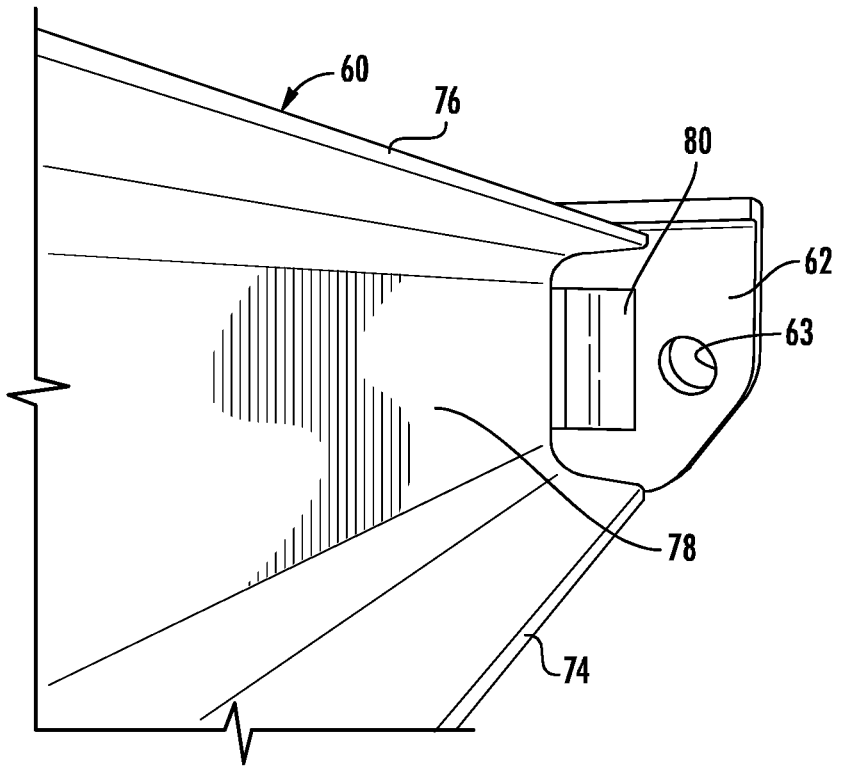
FIG. 11 is a perspective view of the bottom retainer, beam clips, and installed I-beam, in accordance with some embodiments of the present disclosure.
Figure 12:
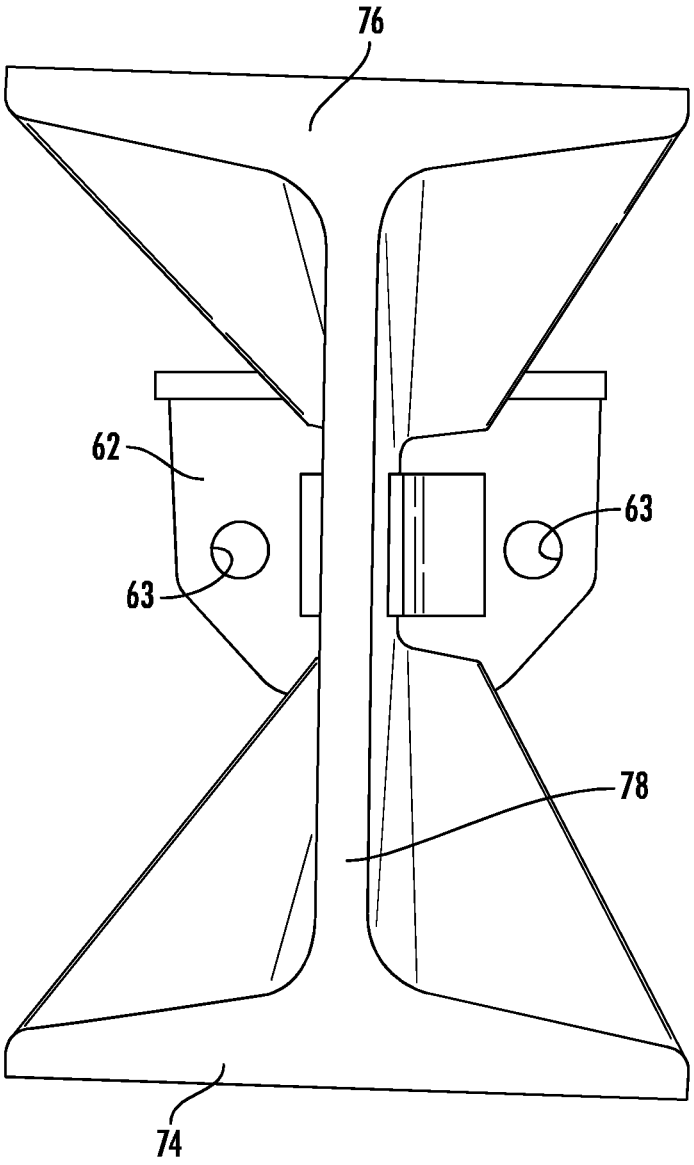
FIG. 12 is a top plan view of the bottom retainer, beam clips and installed I-beam.
Figure 13:
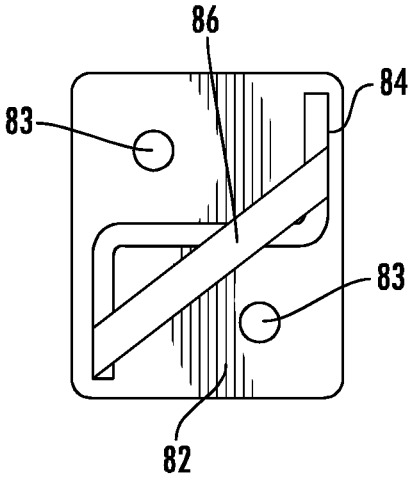
FIG. 13 is a side elevation view of a joist mounting assembly as shown in FIG. 1.
Figure 14:
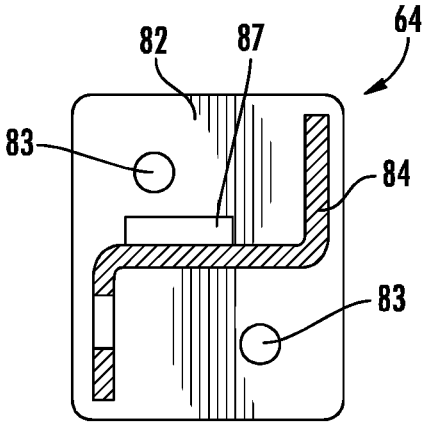
FIG. 14 is a transverse cross-section view of the mounting assembly as shown in FIG. 13.
Figure 15:
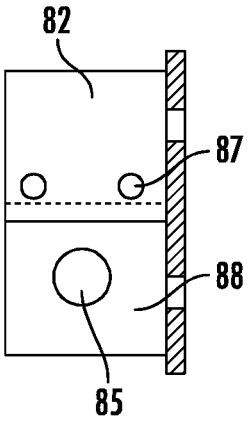
FIG. 15 is front elevation view of the mounting assembly as shown in FIG. 13.
Figure 16:
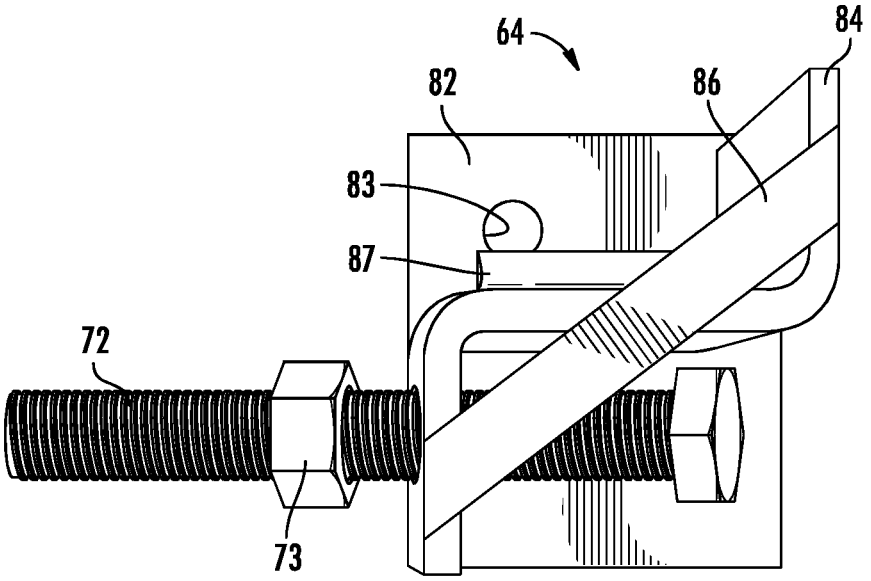
FIG. 16 is a side elevation view of the joint mounting assembly without a hydraulic ram, in accordance with some embodiments of the present disclosure.
Figure 17:
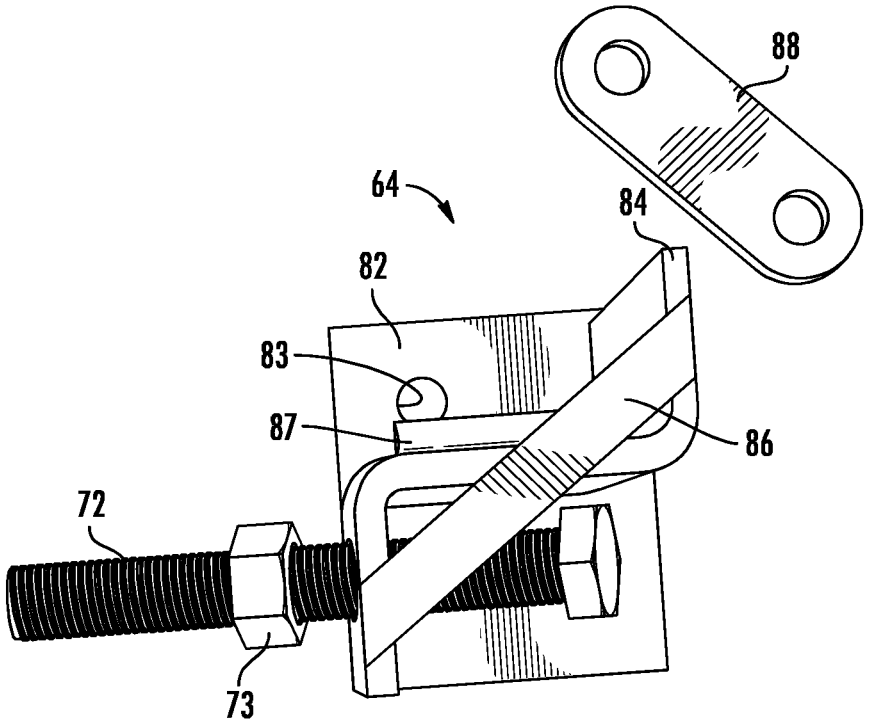
FIG. 17 is side elevation view of the washer plate adjacent the mounting assembly as shown in FIG. 16.

It should be understood that the retainer 62 may be made of any size and shape. For example, the retainer 62 may be sized to allow the holes 63 of the retainer to be positioned directly next to the first end of the structural member 60 (e.g., as illustrated in FIGS. 10 and 11). However, it should be understood that the retainer 62 may be sized to allow the holes 63 to be positioned farther away from the structural member 60. For example, the retainer 62 may extend past the structural member 60 and away from a wall (e.g., when installed), in order to allow the fasteners to be operatively coupled the retainer 62 away from the wall and the structural member 62. Such a location away from the conversion of the wall and floor may provide an improved location for securing the retainer 62 to the floor (or other support), either structurally or due to ease of installation.

The retainer 62 may comprise one or more flanges 81, which may be operatively coupled to the retainer 62. For example, one or more flanges 81 may be formed by bending edges of the retainer 62. In other examples, the one or more flanges 81 may be in the form of one or more clips that are operatively coupled to the retainer 62. The one or more clips (e.g., two angled beam clips 80) may be operatively coupled (e.g., welded, or the like) to a surface (e.g., an upper surface, or the like) of the retainer 62. Each beam clip 80 may have two legs angled perpendicularly to one another. When welded to the retainer 62, upright portions of the beam clips 80 are parallel and slightly spaced apart. As seen in FIGS. 4 and 10-12, in some embodiments, the space is sized for receiving the web 78 of the beam 60 inserted between the upright portions of the beam clips 80 when the beam 60 is placed on the retainer 62 and positioned against the wall 52. It should be understood that the flanges 81, such as the beam clips 80, may be utilized to stabilize the beam 60 adjacent the wall 52.

In some embodiments of the present disclosure, the retainer 62 may also have one or more channels (not illustrated), such that water may be able to pass under the retainer 62 and/or structural member 60. Since the wall brace 50 system is often installed in areas that are prone to accumulate water, the one or more channels in the retainer may be utilized in order to allow water to pass under or through at least a portion of the retainer 62, thus reducing or preventing the pooling of water around the retainer 62, which may reduce or prevent damage to the retainer 62 and/or the structural member 60 over time. It should be understood that the one or more channels may be formed of any shape (e.g., rectangular, circular, square, or any other uniform or non-uniform shape).

Figure 18:
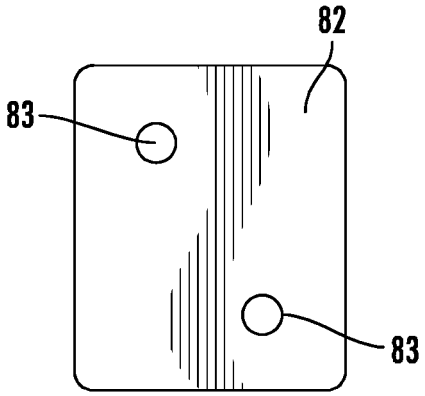
FIG. 18 is a side elevation view of a base plate for use in the mounting assembly as shown in FIG. 13.
Figure 19:
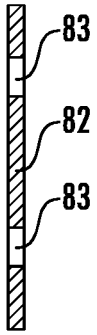
FIG. 19 is a transverse cross-section view of the base plate as shown in FIG. 18.
Figure 20A:
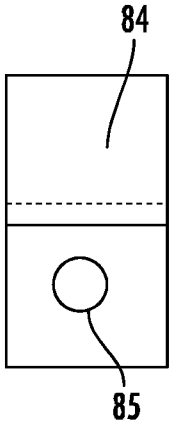
FIG. 20A is a front elevation view of a support bracket for use in the mounting assembly as shown in FIG. 13.
Figure 20B:
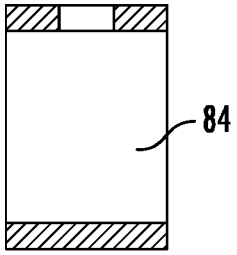
FIG. 20B is a top elevation view of a support bracket for use in the mounting assembly as shown in FIG. 13.
Figure 20C:
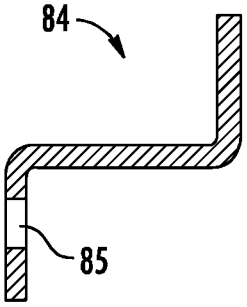
FIG. 20C is a transverse cross-section view of a support bracket for use in the mounting assembly as shown in FIG. 13.
Figure 20D:
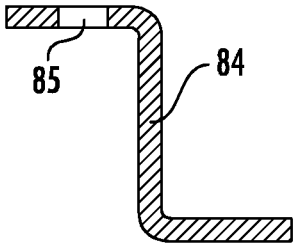
FIG. 20D is a transverse cross-section view of a support bracket for use in the mounting assembly as shown in FIG. 13.
Figure 21:
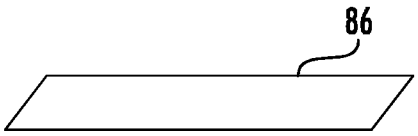
FIG. 21 is a side elevation view of a cross brace for use in the mounting assembly as shown in FIG. 13.
Figure 22A:
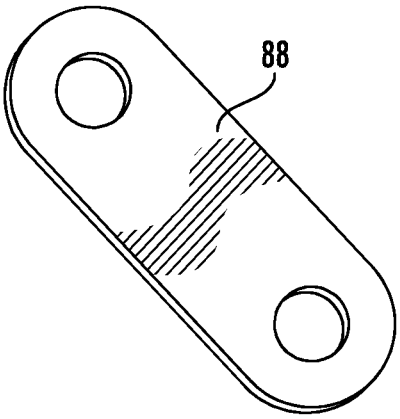
FIG. 22A is a side elevation view of the washer plate, in accordance with some embodiments of the present disclosure.
Figure 22B:
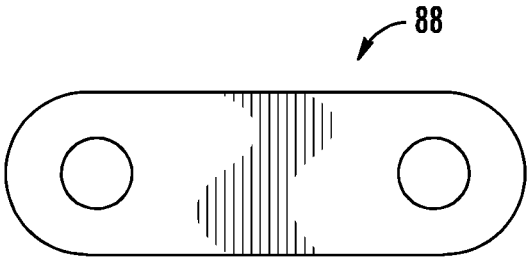
FIG. 22B is a side elevation view of the washer plate as shown in FIG. 22A.
Figure 23:
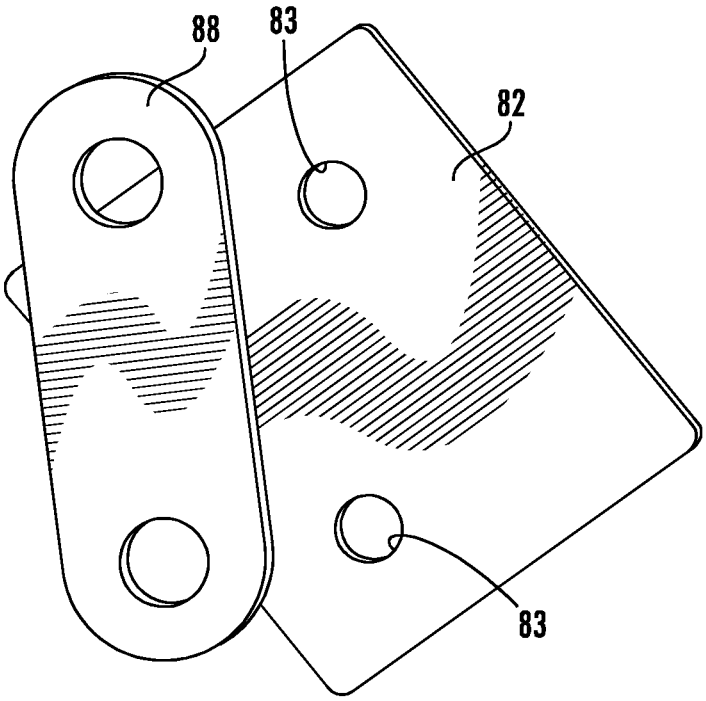
FIG. 23 is a top perspective view of the washer plate suspended apart from the mounting assembly, in accordance with some embodiments of the present disclosure.
Figure 24:
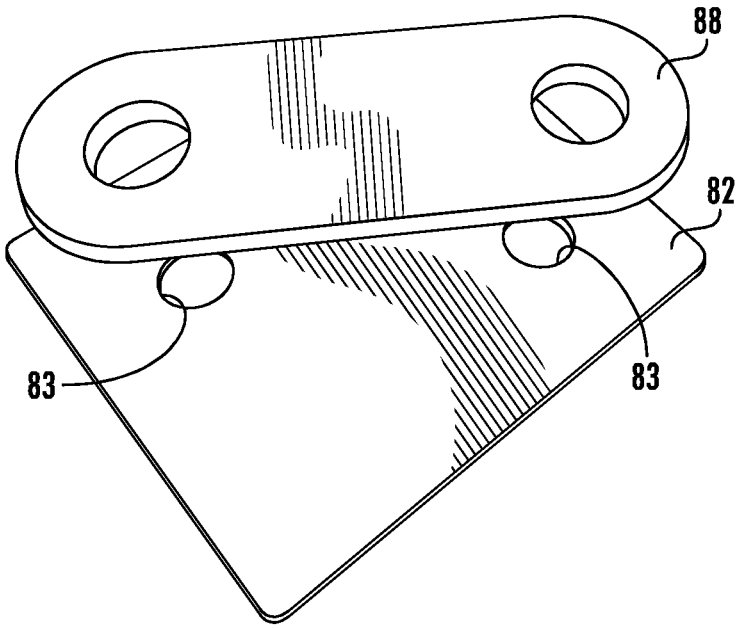
FIG. 24 is a top perspective view of the washer plate suspended over the mounting assembly, in accordance with some embodiments of the present disclosure.
Figure 25:
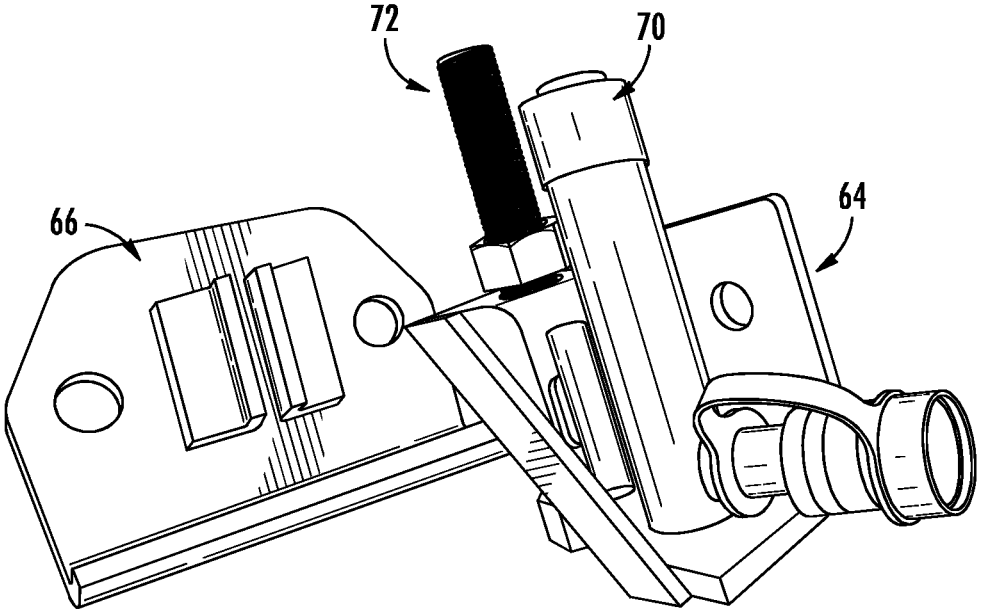
FIG. 25 is a perspective view of the mounting assembly and bottom retainer including beam clips, in accordance with some embodiments of the present disclosure.
Figure 26:
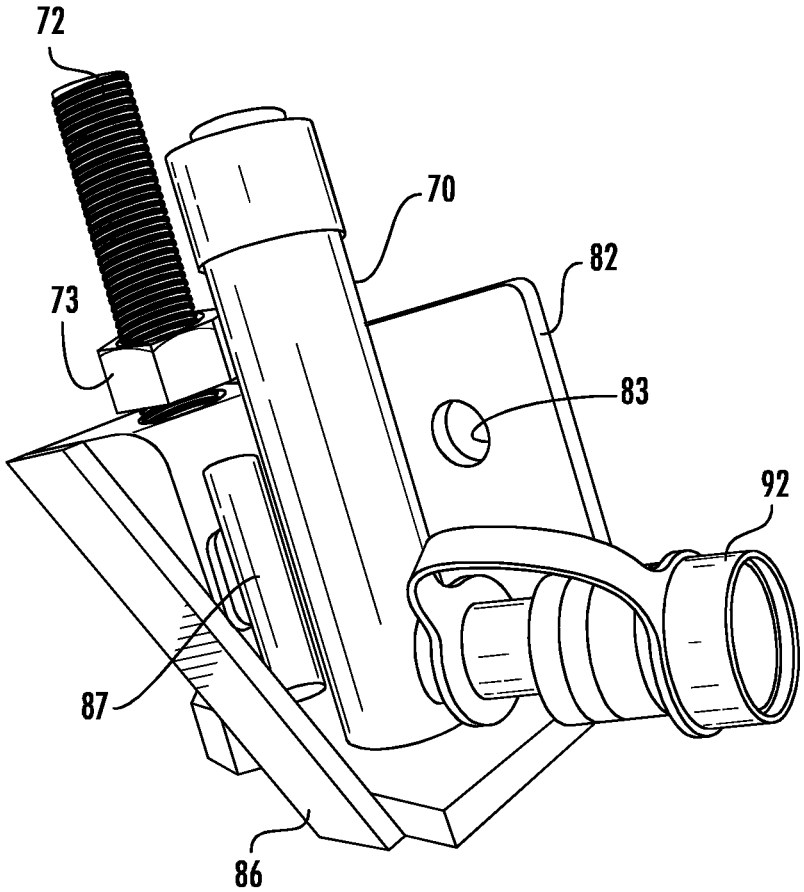
FIG. 26 is a top perspective view of the mounting assembly and bottom retainer including beam clips as shown in FIG. 25.
Figure 27:
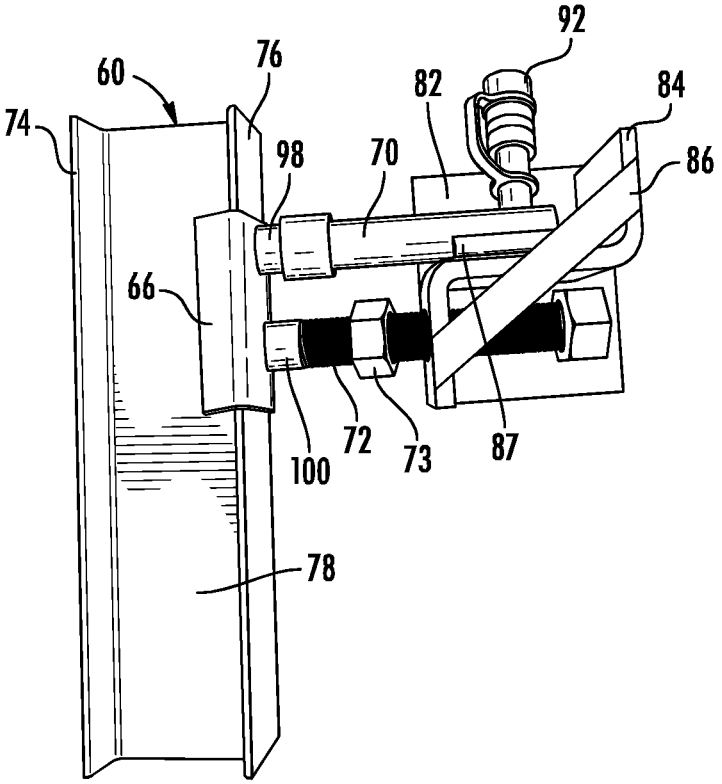
FIG. 27 is a side elevation view of the mounting assembly engaging a load member, and a portion of a beam, in accordance with some embodiments of the present disclosure.
Figure 28:
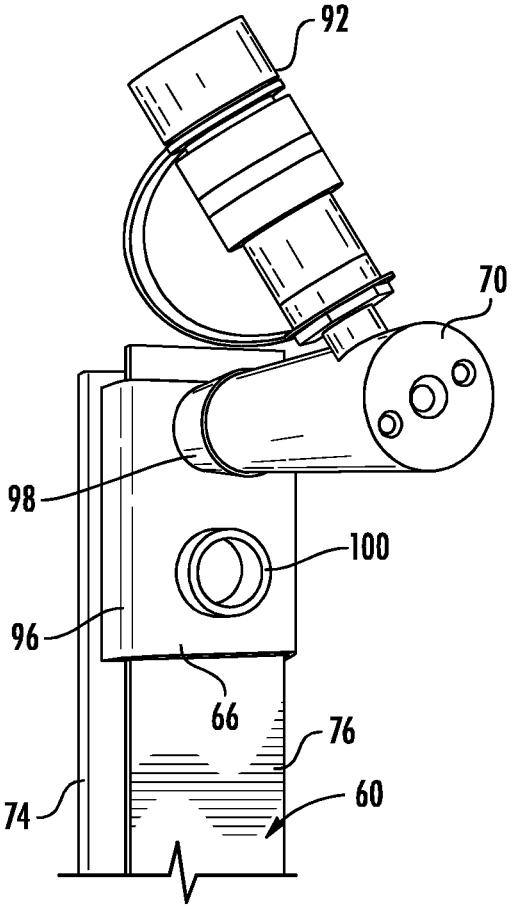
FIG. 28 is a front perspective view of a hydraulic ram engaging a load member and a portion of a beam, in accordance with some embodiments of the present disclosure.
Figure 29A:
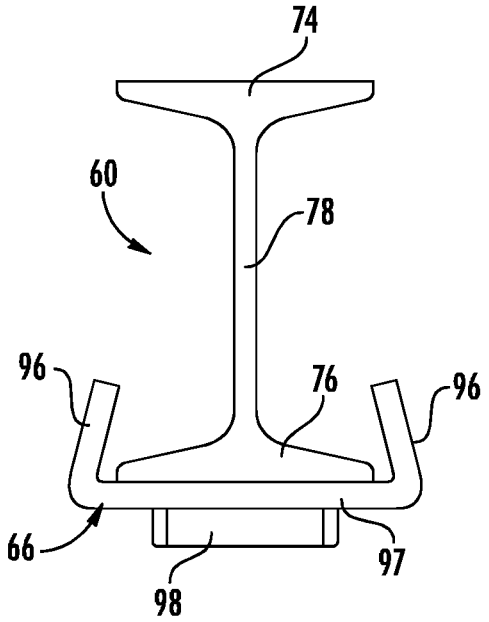
FIG. 29A is a top plan view of the beam and load plate, in accordance with some embodiments of the present disclosure.
Figure 29B:
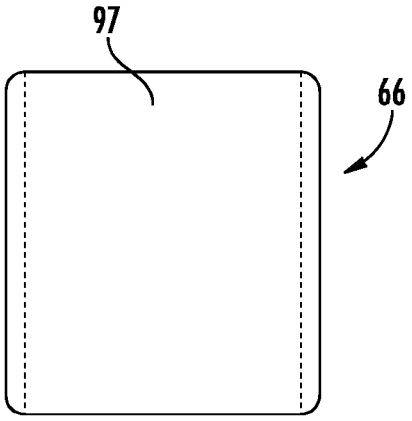
FIG. 29B is a front elevation view of the load member as shown in FIG. 29A.
Figure 29C:
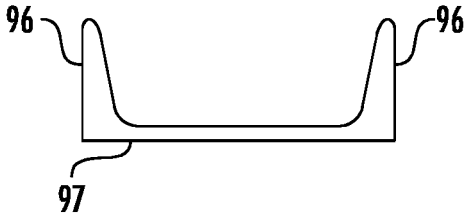
FIG. 29C is a top plan view of the load member as shown in FIG. 29A.
Figure 29D:
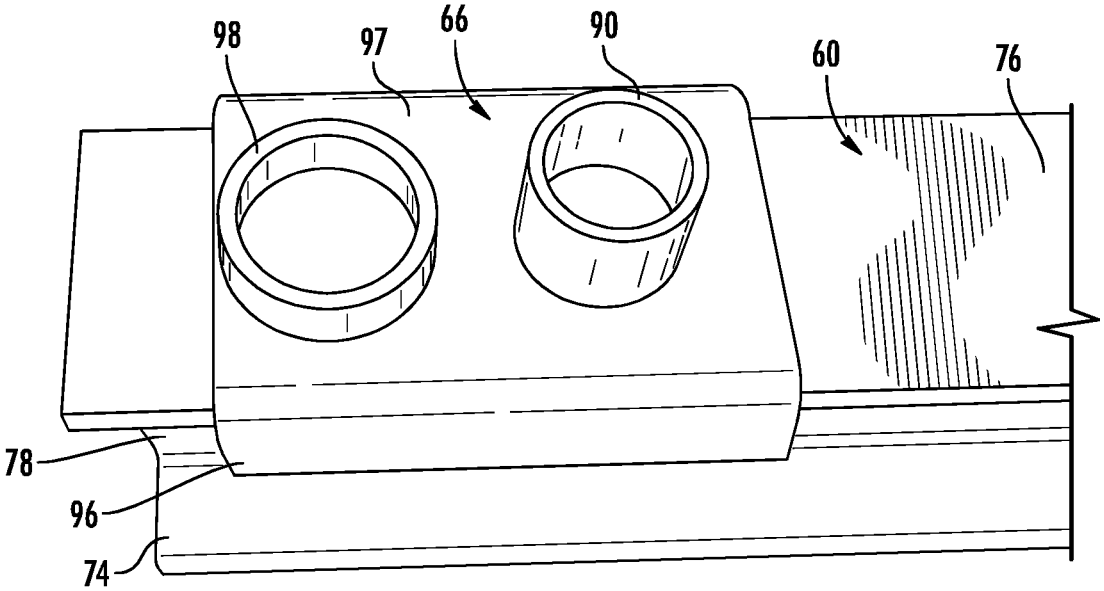
FIG. 29D is a perspective view of the load member and I-beam as shown in FIG. 29A.
Figure 29E:
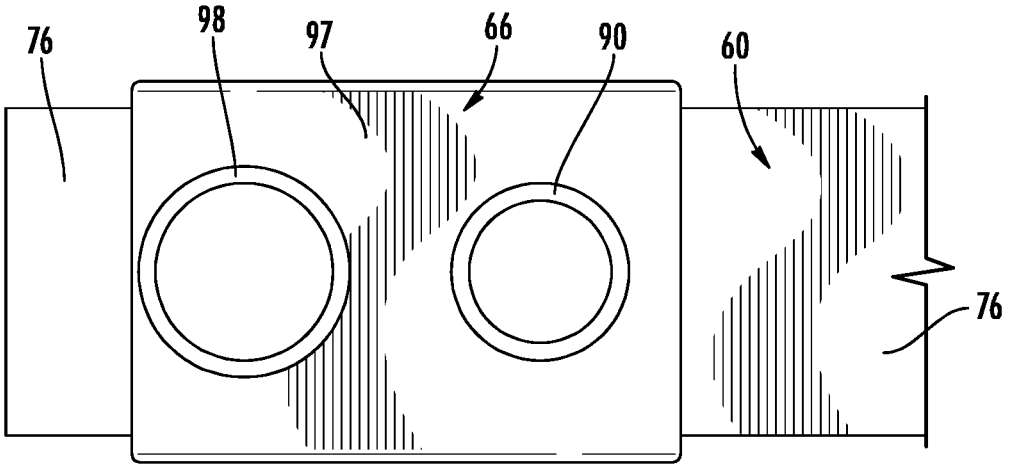
FIG. 29E is a top perspective view of the load member and I-beam as shown in FIG. 29A.
Figure 29F:
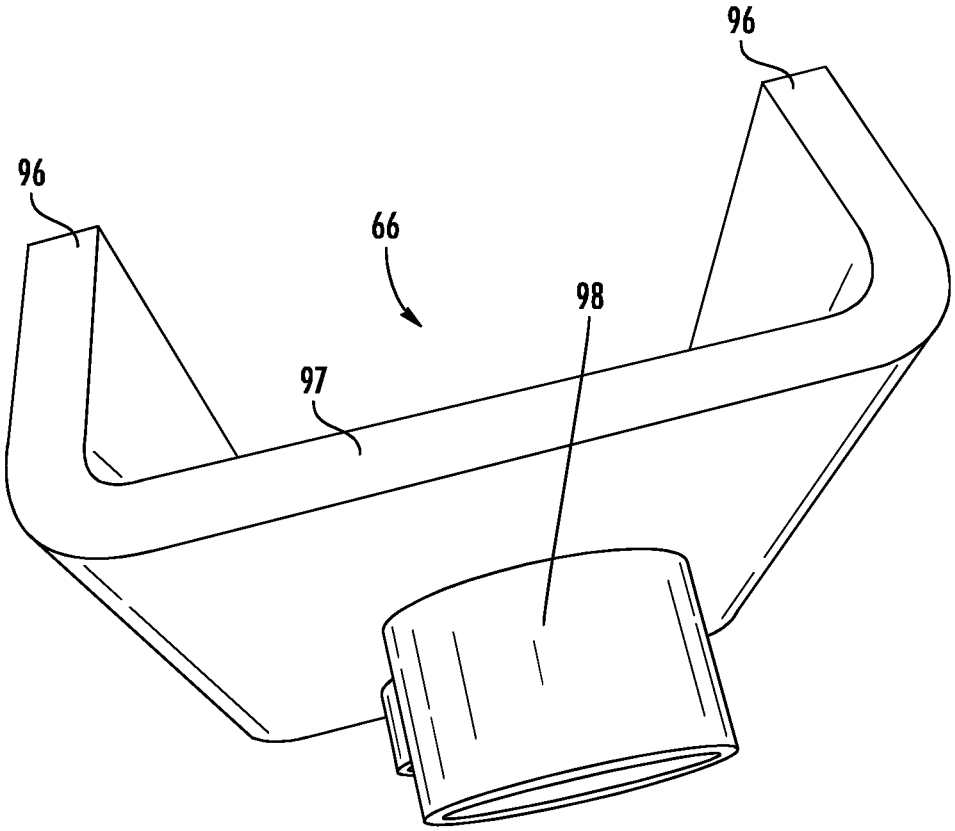
FIG. 29F is a perspective top plan view of the load member as shown in FIG. 29A.

Referring now to FIGS. 13-17, the mounting assembly 64 provides means for maintaining the beam 60 generally immovable under force. In some embodiments, the mounting assembly comprises a base plate 82 (as illustrated FIGS. 18 and 19), an S-shaped bracket 84 (as illustrated in FIG. 20), and a cross brace 86 (as illustrated in FIG. 21). The base plate 82 may have a pair of holes 83 formed in opposite corners to receive fasteners (e.g., bolts, or the like) for securing the mounting assembly 64 to a building member (e.g., the floor joist 58, or the like); however, it should be understood that any number of holes 83 and/or fasteners may be utilized in any pattern. The base plate 82 may be mounted to the floor joist 58 by a pair of conventional bolts extending through the holes 83 and into the floor joist 58. One or more washers, such as a single elongated washer 88 (as illustrated in FIGS. 22A-24) slides onto the bolts prior to being secured with nuts. The base plate 82 is thus fixed in place in such a way that the mounting assembly 64 can support substantial forces.

As shown in FIG. 20, the mounting assembly 64 may further comprise a bracket 84 (e.g., an S-shaped steel plate, or the like) operatively coupled (e.g., welded, or the like) to the base plate 82. The locking member 72, such as a bolt, may extend through a hole 85 in a portion of the bracket 84 (e.g., through one leg) for applying a force to the beam 60. A nut 90 is threaded onto the bolt 72. In some embodiments the outer end of the locking member 72 may seat against a surface of the beam 60 directly, against a locking interface (e.g., socket located on the beam), against a load member 66 (e.g., on a surface of the load plate, or within a locking interface on the load plate), thus engaging the upper end of the beam 60.

Referring now to FIGS. 25-28, the jack 70 may be placed in a supporting cradle comprising a pair cylinder alignment guides 87 operatively coupled (e.g., welded, or the like) to the mounting assembly (e.g., leg of the bracket 84). For example, in some embodiments a first end of the jack 70 seats against a leg of the bracket 84, and the other end of the jack 70 seats against the load plate 66 on the beam 60. The jack 70 is configured to expand and retract between the mounting assembly (e.g., the bracket 84) and the beam 60 (e.g., directly or through a load member 66). Additionally, or alternatively, the jack 70, such as the hydraulic jack, may installed through an aperture in the mounting assembly 64 (e.g., within the bracket 84, or the like).

The structure of the mounting assembly 64, and the manner in which the mounting assembly 64 is operatively coupled (e.g., mounted, or the like) adjacent the wall 52, may vary according to the circumstances encountered in any given situation. For example, the joists 58 may run parallel to the wall, and/or the mounting assembly 64 may be required to be installed in a different orientation. As such, it should be understood that the mounting assembly 64 may be configured differently from the mounting assembly 64 illustrated in the FIGs. Consequently, it should be understood that the structure of the mounting assembly 64 may include one or more plates 82, brackets 84, and/or cross-braces 86 in different orientations as needed to operatively couple the mounting assembly 64 to one or more building members.

It is understood that the distance between beam 60 and at least a portion of the mounting assembly 64, such as the bracket 84, is to be spaced large enough to accommodate the later installation and/or removal of the jack 70 therebetween, yet small enough so that the jack 70 has substantial travel available after installation in order to move the beam 60 to the desired location. In this way, the mounting assembly 64 may be operatively coupled to a building member in a location to provide the desired space. Alternatively, in some embodiments of the invention, a portion of the mounting assembly 64 (e.g., base plate 82, or the like) may remain stationary with respect to the building member, while another portion of the mounting assembly 64 (e.g., bracket 84, or the like) may be adjustable and/or replaceable in order to adjust the travel space to account for different spaces of travel of the jack 70.

In some embodiments of the invention, one end of the jack 70 is supported by the bracket 84 with an extendable shaft 71 oriented along a horizontal axis. In the case of a hydraulic jack, the jack 70 may receive hydraulic fluid through a controllable valve 92. Pressure fluid is admitted to or exhausted from the jack 70 by means of a hydraulic hose 94 connecting with the valve 92. As is understood, hydraulic jack cylinders provide for an enclosed chamber that may be pressurized with a hydraulic fluid to apply force to an axially extendable and retractable shaft 71 communicating with the enclosed chamber through a piston sealably slidable in the cylinder. Thus, the jack 70 can be actuated to extend the shaft 71 toward the beam 60 and force the wall 52 toward the vertical position under hydraulic pressure. The locking member 72, extends in a direction parallel to the shaft 71 of the jack 70, such as a threaded locking rod that is adjustable. The locking member 72 is used to engage the beam 60 at the position to which the jack 70 has moved the beam 60. The locking member 72 functions to hold the position of the beam 60 and the wall 52 as achieved by the pressure of the jack 70. It is understood that while the jack 70 is described as a hydraulic jack, as discussed herein, it can be replaced with, a pneumatic jack, electric jacks (e.g., screw jack, or the like), or other like jacks, and as such any type of jack 70 having characteristics similar the hydraulic jack may be used.

Referring to FIGS. 4 and 29A-29F, in some embodiments, the load member 66 may be a load plate that comprises a generally C-shaped pad having side flanges 96 connected to a web 97 which fits slidably over an inner flange 76 of the beam 60. As shown, the web 97 is of a width which is just greater than that of the inner flange 76 of the beam 60 so that the web 97 of the load plate 66 extends laterally across and adjacent the inner flange 76 and the load plate flanges 96 may extend past the side edges of the inner flange 76. In use, the shaft 71 of the jack 70 is forced against the web 97 of the load plate 66 which, in turn, is forced against the inner flange 76 of the beam 60. Thus, the force load delivered by the jack 70 is transferred to the outer flange 74 of the beam 60 through both of the webs 78, 97.

Figure 30:
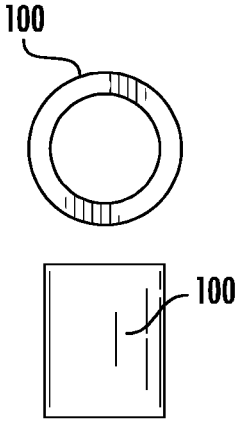
FIG. 30 is front and side views of a socket for an end of a locking member.
Figure 31:
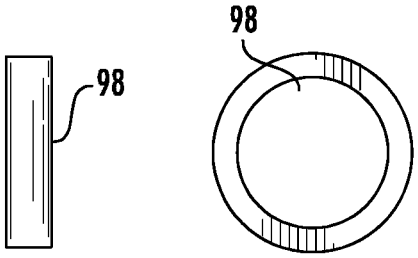
FIG. 31 is front and side views of a socket for an end of a jack.
Figure 32:
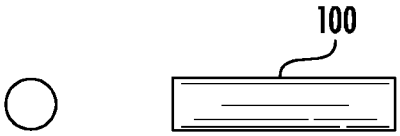
FIG. 32 is front and side views of a jack alignment guide

In some embodiments, spaced interfaces, such as vertically spaced sockets 98, 100 (e.g., circular sockets as illustrated in FIGS. 30 and 31) are mounted directly to the inner flange 76, or the inner surface of the load plate 66 along a central longitudinal axis. The sockets 98, 100 extend axially inwardly and are configured to receive the outer ends of the jack 70 and the locking member 72, respectively. The sockets 98, 100 are preferably metal, but can be made of any material that has sufficient strength, including composite or plastic. The sockets 98, 100 are mounted to the load member 66, or in other embodiments directly to the beam 60, using suitable means, such as welding, adhering, or the like, or the sockets 98, 100 are formed integral with the beam 60. It should be understood that the sockets 98, 100 are strong enough to resist fracture under the loading of the jack 70 and/or other forces imparted by the locking member 72. The sockets 98, 100 may be any type of shape to facilitate operative coupling with a portion of the jack 70 and/or locking member 72. In some embodiments, the inner diameters of the sockets 98, 100 are at least slightly greater than the outer diameter of the shaft 71 of the jack 70 and the locking member 72, which are free to move within the sockets 98, 100 (e.g., in and out of the sockets). However, the sockets 98, 100 may be any shape and size, and in some embodiments may be slotted, or otherwise allow for movement between the structural member 60 and/or load member 66, and the jack 70 and/or locking member 72, as the wall brace system 50 is being installed. The sockets 98, 100 enable the shaft 71 of the jack 70 and the locking member 72 to seat securely against the load plate 66.

FIG. 33 illustrates a method of installing and/or using the wall brace system 200, in accordance with embodiments of the invention. As illustrated by block 202, the retainer 62 is operatively coupled adjacent a first portion of the wall 52 (e.g., near the bottom of the wall). For example, the bottom retainer 62 may be operatively coupled (e.g., mounted) to the floor 54, foundation 53, or other basement floor member.

As illustrated by block 204 in FIG. 33, once the retainer 62 is secured in place, the structural member 60 (e.g., beam) is operatively coupled to the retainer 62, for example placed in the retainer 62 such that web 78 of an I-beam is received between the upwardly extending flanges 81 (e.g., beam clips 80, or the like). The one or more retainer flanges 81, such as the beam clips 80, restrict movement of the lower end of the structural member 60 away from and/or parallel with the wall 52. The structural member 60 may be seated as vertically as possible against the wall 52. At the upper end, the structural member 60 is typically spaced from the wall 52 an amount determined by the bowing of the wall.

Block 206 of FIG. 33 illustrates that the mounting assembly 64 is operatively coupled to a building member, such as a floor joist 58, spaced inwardly from the upper end of the structural member 60, as described herein.

FIG. 33 further illustrates in block 208 that the jack 70 and/or the locking member 72 are operatively coupled to the mounting assembly 64 and/or the structural member 60, directly or indirectly, through a load member (e.g., interposed between the bracket 84 and the beam 60). It should be understood that the jack 70 and locking member 72 may be installed together, or at separate times (e.g., the jack 70 may be installed before the locking member 72, or vice versa). In some embodiments the locking member 72 may be installed after the jack 70 positions the structural member (e.g., after block 210, or the like).

Block 210 illustrates that the jack 70 is extended, for example, the shaft 71 of the jack 70 is extended and exerts outwardly directed forces against the structural member 60, directly or through the load member 66, toward the wall 52 for moving and supporting the wall 52. For example, the load member 66 transmits the force of the jack 70 to the inner flange 76 of the structural member 60, and thus, to the outer flange 74 through the web 78 of the structural member 60 so that the outer flange 74 of the structural member 60 is urged against the wall 52 exerting force on the wall 52 until the wall 52 has been pushed back into position. The jack 70 may allow the installer to measure the amount of force applied to the structural member 60, and thus, the wall. The measurement of the force may also be used to allow an installer to recheck the wall brace system 50 in the future, and to readjust the force being applied (e.g., add more force or reduce the force).

Block 212 of FIG. 33 illustrates that when the wall 52 reaches its desired position, the structural member 60 is secured by the locking member 72 so as to prevent the wall 52 from moving inwardly. As described herein, the locking member 72 may comprise a locking rod that extends from the mounding assembly 64, and applies a force to the structural member 60. In some embodiments the locking member 72 is threaded, and as such, the locking member 72 is rotated until the outer end seats against the structural member 60 and/or the load member 66, such as in the socket 100 against the surface of the load member 66. Upon further tightening of the locking member 72, the locking member 72 will apply a force against the upper end of the structural member 60 that increases as the locking member 72 is rotated further. The actuation of the locking member 66 secures the structural member 60 in position so that the wall 52 is held in place with the locking member 66. For example, once the locking member 72 is tightened to the desired force, a nut 73 may be threaded against the mounting assembly 64 (e.g., the bracket 84) for securing the locking member 72 in position.

Block 214 of FIG. 33 illustrates that the jack 70 is removed from the mounting assembly 64 after the locking member 72 is positioned. The jack 70 may then be operatively coupled to other mounting assemblies 64 having other locking members 72 in order to install and/or adjust the structural members 60 of other wall brace systems 50. Moreover, over time, the jack 70 may be operatively coupled to the same mounting assembly 64 to adjust the position of the structural member 60 and/or the locking member 72, as the wall 52 and/or structural member 72 requires movement over time.

It should be understood that the steps described with respect to FIG. 33, and elsewhere within this disclosure, may occur in any order.

The present disclosure generally describes installing a single wall brace system 50, using a single jack 70 to position the structural member 60 of the wall brace system 50, and thereafter, installing another wall brace system 50 and/or using the jack 70 on a separate structural member 60 that is partially installed (e.g., installed but not yet loaded to position the structural member 60, or the like). However, it should be understood that multiple jacks 70 may be utilized at one time to install multiple structural members 60 within one or more wall brace systems 50 (e.g., the wall brace system 50 may be used to describe the installation of a single structural member 60 and associated components or multiple structural members 60 and associated components). For example, in some embodiments two or more wall brace systems 50 (as part of a larger wall support system) may be partially installed (e.g., without using a jack 70 for applying pressure to the individual structural member 60). Two or more jacks 70 may be installed to the two or more wall brace systems 50 (e.g., as each system is being installed or after the systems are installed). The two or more jacks 70 may be operatively coupled to each other (e.g., through a manifold, mechanical control members, software control features, or the like), which allows an installer to operate the two or more jacks 70 at the same time. Consequently, in these embodiments, the multiple jacks 70 may be connected in series and loaded together in order to allow for loading of multiple structural members 60 within the two or more wall brace systems 50 at the same time. It should be further understood that while multiple jacks 70 may be used at the same time, the jacks 70 may apply the same force or different forces to the two or more structural members 60 (e.g., depending on how severely a wall is bowed at the position of each of the structural members 60). In this way, the multiple jacks 70 may be utilized to quickly install the system by applying forces to the structural members 60, and thus, the entire wall (or multiple walls) at the same time. It should be understood that in other embodiments, one or more installers may operate the multiple jacks 70 (e.g., coupled jacks 70 or uncoupled jacks 70) individually to apply the forces to the wall in different locations, as needed.

It should be further understood that the jack 70 and/or locking member 72 may be operatively coupled to the mounting assembly 64 in different orientations, however typically they will be installed in a vertical orientation with respect to each other (e.g., with the jack 70 vertically above the locking member 72, or the locking member 72 above the jack 70). As such, it should be understood that should the structural member 60 be located in a different orientation from vertical (e.g., at an angle), the mounting assembly 64 may be installed in the same plane to allow the jack 70 and locking member 72 to be installed in the same plane as the structural member 60.

It should be further understood that in some embodiments of the invention, the locking member 72 may be located in-line with the jack 70. That is, the locking member 72 and the jack 70 may be operatively coupled to the mounting assembly 64 in-line longitudinally with each other, or otherwise, in a configuration in which the jack 70 is activated to move the locking member 72, which interacts with the structural member 60 (e.g., directly or through the use of the load member 66) to position the structural member 60. That is, the jack 70 engages to the structural member 60 through the use of the locking member 72 itself, and when the structural member 60 is in the desired location, the locking member 72 is locked into place, and the jack 70 is removed from the mounting assembly 64.

In other embodiments of the invention, there may be two or more mounting assemblies, such as a jack mounting assembly and a locking member mounting assembly. In this way, both mounting assemblies 64 may be operatively coupled to a building member. The jack 70 may be further operatively coupled to the jack mounting assembly, and the locking member 72 may be operatively coupled to the locking member mounting assembly. In this way, the jack 70 and the locking member 72 may be located at different locations, should it be required based on the configurations of the building members (e.g., joists, or other support members), installation preferences, and/or as necessary to apply the load to the structural member 60.

In some embodiments of the present disclosure the wall brace system 50 may include a gauge that is operatively coupled to a locking member 72 (or the jack 70 if the jack remains in place), in order to allow an installer to determine how much force is being applied to the wall (or otherwise stated how much force the system—the locking member 72 or the like—is under).

It should be understood that the wall brace system 50 disclosed herein functions as a "force-applying device" to apply an outward force to the foundation wall 52. The jack 70 of the present disclosure exerts a significant outwardly directed force against the beam 60, thereby tending to straighten the wall 52. The jack 70 forces the beam 60, and in turn wall 52, outward to the proper position since the beam 60 ends are secured against movement.

The present invention provides improvements to wall braces, due at least in part to providing the ability to utilize a jack 70 along with the locking member 72 in order to more easily provide the desired load and/or to install the wall brace system 50 (e.g., a single system with a single structural member, or system(s) with multiple structural members). In this way, the one or more jacks 70 can be used to measure the force that is applied to the wall, which provides the ability to revisit the system(s) at a later date to recheck the system(s) and add or reduce the pressure, if needed. Moreover, the mounting assembly 64 provides a location to which the jack 70 can be removably installed in order to allow an installer to quickly install the jack 70 apply the desired loading to the structural member 60, and thus the wall 52, and thereafter, position the locking member 72 to lock the structural member 60 in place, before removing the jack 70. Should only a locking member 72 be utilized, such as a bolt, it may be more difficult for an installer to apply the desired load and/or turn the bolt quickly and effectively. Furthermore, having a location within the mounting assembly 64 for the jack 70 allows an installer to make quick adjustments to individual structural member 60 when installing multiple structural members 60 within a structure. For example, an installer can gradually apply loads to different structural members 60 in order to gradually adjust the position of a wall 52. Alternatively, as described herein, multiple jacks 70 may be utilized to adjust the position of a wall 52 at different locations at the same time.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

Certain terminology is used herein for convenience only and is not to be taken as a limiting. For example, words such as "upper," "lower," "horizontal," "vertical," "upward," "downward," "top" and "bottom", or the like merely describes the configurations shown in the FIGS. Indeed, the components may be oriented in any direction and the terminology, therefore, should be understood as encompassing such variations unless specified otherwise. The words "interior" and "exterior" refer to directions toward and away from, respectively, the geometric center of the core and designated parts thereof. The terminology includes the words specifically mentioned above, derivatives thereof and words of similar import.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A wall bracing system, the wall bracing system comprising:
- a structural member having a first end and a second end;
- a mounting assembly comprising:
  - a base plate; and
  - a bracket operatively coupled to the base plate, wherein the bracket comprises
    - a first leg;
    - a second leg; and
    - a third leg connecting the first leg and the second leg;
    - wherein the first leg the second leg and the third leg form an s-shaped bracket; and
    - wherein the first leg includes a locking aperture;
  - wherein the mounting assembly is operatively coupled to a building member;
- a locking member operatively coupled to the mounting assembly through the locking aperture; and
- a jack operatively coupled to the mounting assembly, wherein the bracket supports the jack when the jack applies a force to the structural member;
- wherein the first end of the structural member is operatively coupled adjacent a bottom portion of a wall and the second end of the structural member is operatively coupled adjacent a top portion of the wall;
- wherein the jack is configured to apply the force to the structural member and the locking member is configured to resist movement of the structural member; and
- wherein at least a portion of the jack is removable while the locking member remains operatively coupled to the mounting assembly and the structural member.

2. The wall bracing system of claim 1, wherein the locking member comprises:
- a bolt having a bolt head on one side of the first leg; and
- a locking nut on an opposing side of the first leg for securing the bolt in position.

3. The wall bracing system of claim 1,
- wherein the second leg supports the jack when the mounting assembly is supported on a side of the building member; and
- wherein the first leg supports the jack when the mounting assembly is supported on a lower surface of the building member.

4. The wall bracing system of claim 1, further comprising:
- a cross-brace between the first leg and the second leg.

5. The wall bracing system of claim 1, wherein the base plate and the bracket are adjustable with respect to each other.

6. A mounting assembly for a wall bracing system, the mounting assembly comprising:

a base plate; and a bracket operatively coupled to the base plate, wherein the bracket comprises:

a first leg;

a second leg; and a third leg connecting the first leg and the second leg;

wherein the first leg the second leg and the third leg form an s-shaped bracket; and wherein the first leg includes a locking aperture;

wherein the bracket is configured to be operatively coupled to a locking member through the locking aperture;

wherein the bracket is configured to be operatively coupled to a jack and support the jack when the jack applies a force to a structural member;

wherein the jack is configured to adjust the structural member and the locking member is configured to resist movement of the structural member; and wherein at least a portion of the jack is removable while the locking member remains operatively coupled to the mounting assembly and the structural member.

7. The mounting assembly of claim 6, wherein the locking member comprises:

a bolt having a bolt head on one side of the first leg; and a locking nut on an opposing side of the first leg for securing the bolt in position.

8. The mounting assembly of claim 6, further comprising:

a cradle operatively coupled to the base plate or the bracket, wherein the cradle supports the jack within the mounting assembly.

9. The mounting assembly of claim 6, wherein the second leg supports the jack when the mounting assembly is supported on a side of the building member; and wherein the first leg supports the jack when the mounting assembly is supported on a lower surface of the building member.

10. The mounting assembly of claim 6, further comprising:

a cross-brace between the first leg and the second leg.

11. The mounting assembly of claim 6, wherein the base plate and the bracket are static with respect to each other.

12. The mounting assembly of claim 6, wherein the base plate and the bracket are adjustable with respect to each other.

13. A method of using a wall bracing system, the method comprises:

installing a mounting assembly to a building member, wherein the mounting assembly comprises:

a base plate; and a bracket operatively coupled to the base plate, wherein the bracket comprises:

a first leg;

a second leg; and a third leg connecting the first leg and the second leg;

wherein the first leg the second leg and the third leg form an s-shaped bracket; and wherein the first leg includes a locking aperture;

installing a structural member having a first end and a second end adjacent a wall;

installing a locking member to the mounting assembly through the locking aperture;

installing a jack to the mounting assembly, wherein the bracket supports the jack when the jack applies a force to the structure member;

activating the jack to apply the force to the structural member directly or through a load member;

engaging the locking member to restrict movement of the structural member; and removing a least a portion of the jack from the mounting assembly.

14. The method of claim 13, wherein the second leg supports the jack when the mounting bracket is supported on a side of the support member, and wherein the first leg supports the jack when the mounting bracket is supported on a lower surface of the support member.

15. The method of claim 13, further comprising:

installing a retainer adjacent a first portion of the wall;

wherein installing the structural member comprises assembling the first end of the structural member to the retainer; and wherein the jack applies the force to the structural member adjacent the second end of the structural member.

* * * * *